United States Patent [19]

Dauenbaugh

[11] 4,233,828

[45] Nov. 18, 1980

[54] CHANGEABLE COMBINATION, AXIAL PIN TUMBLER LOCK WITH SINGLE INTERFACE

[75] Inventor: Robert L. Dauenbaugh, Rockford, Ill.

[73] Assignee: Keystone Consolidated Industries, Inc., Peoria, Ill.

[21] Appl. No.: 963,156

[22] Filed: Nov. 22, 1978

[51] Int. Cl.[3] ..... E05B 27/00

[52] U.S. Cl. ..... 70/363; 70/383

[58] Field of Search ..... 70/383, 382, 363, 384

[56] References Cited

U.S. PATENT DOCUMENTS

| | | | |
|---|---|---|---|
| 3,422,646 | 1/1969 | Monahan | 70/363 |
| 3,648,492 | 3/1972 | Walters | 70/363 |

*Primary Examiner*—Robert L. Wolfe

*Attorney, Agent, or Firm*—Allegretti, Newitt, Witcoff & McAndrews

[57] ABSTRACT

A changeable combination, axial pin tumbler lock is operable by means of a cylindrical service key. Set keys are used to change the tumbler combination and thereby provide for operation of the lock by a different service key. The lock includes a fixed cylindrical barrel with twelve tumbler passages in opposed relation with a rotatable plug and barrel having seven tumbler passages. One half of the passages of the fixed barrel store reserve tumblers. A single shear interface is defined by the plug barrel and fixed barrel. Transfer of reserve tumblers from the fixed barrel passages to the plug barrel passages by means of set keys effects a combination change.

12 Claims, 19 Drawing Figures

CHANGEABLE COMBINATION, AXIAL PIN TUMBLER LOCK WITH SINGLE INTERFACE

BACKGROUND OF THE INVENTION

This invention relates to an axial pin tumbler lock cooperative with a cylindrical key and capable of having tumbler combination changes by means of various set keys while normal lock operation is effected by means of an appropriate service key.

Vending machines require periodic service to collect revenues, resupply vended articles and the like. Typically a series of such machines include locks which are identical and which are operated by the same, identical service key. Thus a service man or revenue collector will use the single key for servicing a number of separate machines.

In order to maintain security for such machines, one must often change the locks or alternatively change the combination for the locks incorporated with such machines. Changing vending machine locks is time consuming and costly. Consequently, various locks have been developed that incorporate a mechanism rendering such locks capable of having their combination changed. The combinations are generally changed by re-arranging the tumblers within the locking mechanism for the lock.

Numerous prior art patents disclose means for changing the tumbler combination of a lock. Among these prior art patents are the following: Schlage, U.S. Pat. No. 3,411,331, Axial Pin Cylinder Device, issued Nov. 19, 1968; Monahan, U.S. Pat. No. 3,422,646, Instantaneous Tumbler Change Lock, issued Jan. 21, 1969; Christopher, U.S. Pat. No. 3,102,412, Tumbler Lock with Axially Shiftable Interchangeable Tumblers, issued Sept. 3, 1963; Kerr, U.S. Pat. No. 3,261,188, Quick Change Axial Pin Tumbler Lock Assembly, issued July 15, 1966; Pepper, U.S. Pat. No. 1,707,922, Lock, issued Apr. 2, 1929; Best, U.S. Pat. No. 3,206,958, Interchangeable Lock Cores, issued Sept. 21, 1965; Kerr, U.S. Pat. No. 3,251,205, Quick Change Axial Pin Tumbler Lock Assembly, issued May 17, 1966; Kerr, U.S. Pat. No. 3,258,944, Assembly Jig for Facilitating Lock Tumbler Changeover Operations, issued July 5, 1966; Faulk, U.S. Pat. No. 3,728,880, Rekeyable Axial Pin Tumbler Lock, issued Apr. 24, 1973; Faulk, U.S. Pat. No. 3,738,136, System for Master Key and Axial Pin Tumbler Locks, issued June 12, 1973; and Walters and Brattland, U.S. Pat. No. 3,648,492 for Pin Tumbler Lock and Key Structure issued Mar. 14, 1972.

The referenced patents disclose various types of pin tumbler locks which may have their combinations altered by various means. Some disclose a cylindrical key having circumferential detents. The key is received in an annular opening of a lock where it engages a radial array of axial pin tumblers and depresses those pin tumblers to an appropriate depth within a barrel cylinder to permit rotation of a plug with respect to a cylinder over a shear interface. Some references disclose one shear interface while others disclose multiple shear interfaces. In references disclosing a single interface construction, various arrangements are disclosed for mechanically altering the pin tumbler configuration within the lock barrel to thereby change the combination of the device.

Other references disclose multiple rotating barrel and plug members with additional pin tumblers stored in one of the members. Movement of pin tumblers is then effected across two or more shear interfaces in order to vary the lock combination. Monahan U.S. Pat. No. 3,422,646 discloses such a configuration.

While such prior art lock devices are useful, they are quite complex and require precision manufacture. As a result, a simplified changeable key lock construction is desirable. Moreover, it is desired that such a lock construction be compatible with keys of the type currently available in the marketplace including keys such as the cylindrical key described in Walters et al, U.S. Pat. No. 3,648,492. These considerations, among others, inspired the development of the present invention.

SUMMARY OF THE INVENTION

In a principal aspect the present invention comprises a changeable pin tumbler lock which is normally operated by a cylindrical service key of a prescribed combination. The lock is also adapted to receive a first set by having the same combination as the service key. The first set key may be used to position the lock in a condition where it can be removed so that the lock can receive a separate, second set key to change the combination of the lock. The second set key is then used to set the new combination and is then removed from the lock; whereupon, a new, second service key associated with the second set key can be used to operate the lock.

The lock includes a generally cylindrical, fixed barrel, which defines a shear face. The fixed barrel is cooperative with a plug and attached rotating barrel having an opposing shear face. The fixed barrel and the plug barrel thus define a single shear interface. Pin tumblers are arranged in a plurality of passages defined in the fixed barrel and the plug barrel. The fixed barrel generally has more passages than the plug barrel and includes extra pin tumblers in the extra passages which are used to change the combination of the lock. A key retention mechanism is used to retain each service key in the lock whenever the lock is being operated by a service key. The key retention mechanism permits release and replacement of combination set keys.

Thus it is an object of the present invention to provide an improved changeable, axial pin tumbler lock having a fixed barrel and a cooperative plug barrel defining a single, shear interface.

It is a further object of the present invention to provide a changeable pin tumbler lock having a minimum number of parts and which is economical to manufacture.

Still a further object of the present invention is to provide a changeable pin tumbler lock cooperative with cylindrical type keys and which is compatible with keys commercially used heretofore.

Another object of the present invention is to provide a changeable pin tumbler lock capable of providing a number of distinct tumbler combinations.

A further object of the present invention is to provide a changeable pin tumbler lock which is operated to change combinations solely by keys which are inserted in the keyhole opening of the lock. Removal of parts from the lock or obtaining access to the lock other than by a cylindrical key to change the combination is avoided.

These and other objects, advantages and features of the invention will be set forth in greater detail below.

BRIEF DESCRIPTION OF THE DRAWING

In the detailed description which follows, reference will be made to the drawing comprised of the following figures.

DESCRIPTION OF THE PREFERRED EMBODIMENT

Brief Outline of Lock Operation

Briefly the operation of the lock to change the combination is described as follows:

The lock is generally operated by a first service key 70 which may be inserted into the lock when the lock is locked. The first service key 70 is then rotated clockwise 90° so as to unlock the lock. The first service key may not be removed from the lock except when the lock is in the locked position.

To change the tumbler combination of the lock, a first set key 71 is inserted when the lock is in the locked position. The first set key 71 has bittings which are identical to those of the first service key 70. However, the lock includes a key retention mechanism which permits removal of set keys, such as key 71, from the lock when the lock is in the unlocked condition.

Thus, after the first set key 71 is inserted into the locked lock, it is then rotated 90° clockwise to the unlocked position and removed. Then a second set key 73 is inserted in the lock and the lock is rotated counter-clockwise back to the locked position. Next the second set key 73 is removed and a second service key 75 having bittings identical to those of the second set key 73 can then be used to operate the lock. The first service key 70 can no longer operate the lock and the first set key 71 can only be used again after the lock is turned to the change position with the second set key 73. Set key 71 will not unlock the changed lock in the locked position.

A similar procedure is followed to change the lock combination so as to permit operation by a third service key and a fourth service key, etc. The number of combinations for each single lock is limited only by the number of combination change tumblers as described in detail below.

Description of Lock Structure

Figure 1:
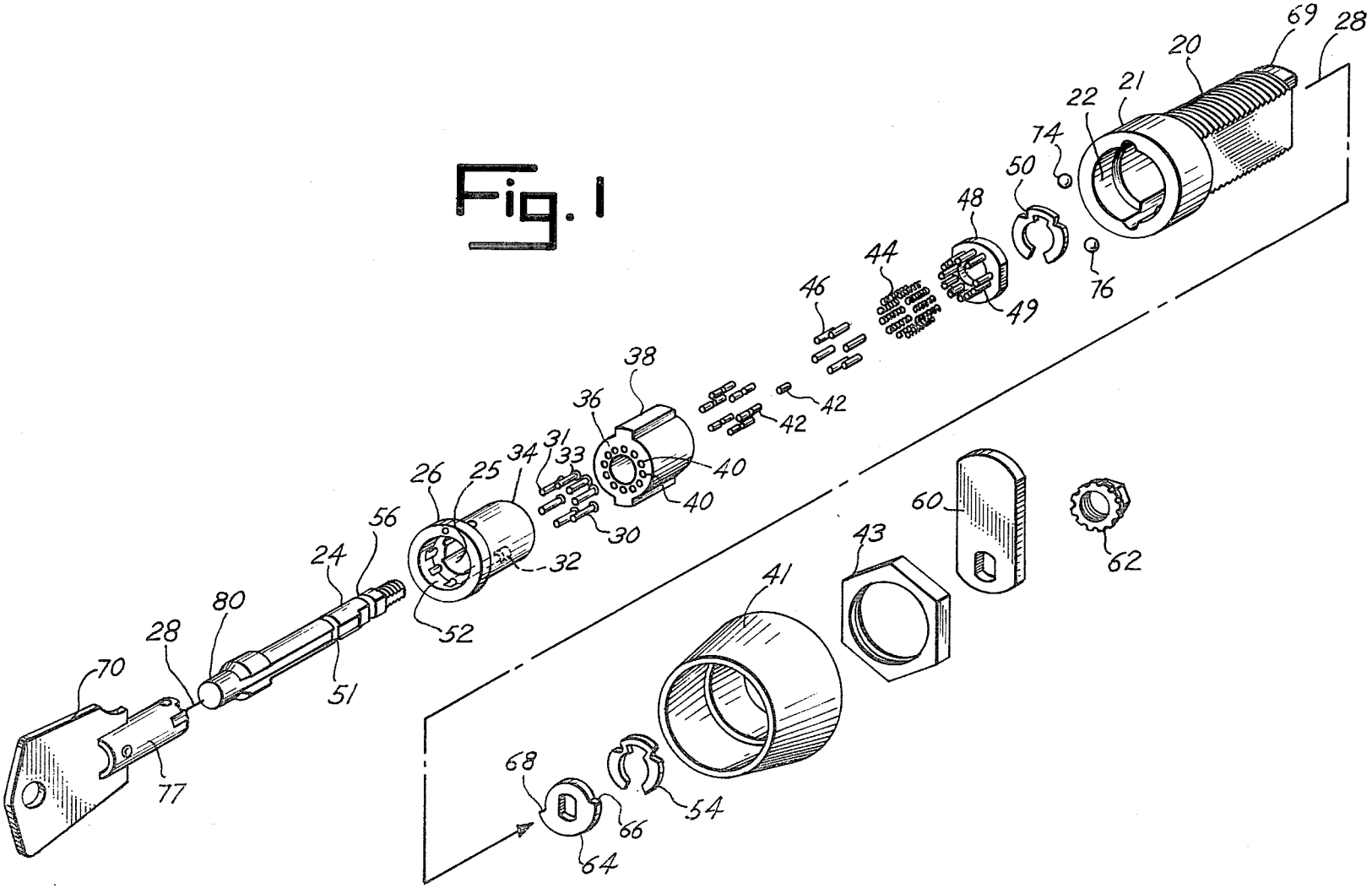
FIG. 1 is an exploded perspective view of the improved changeable, axial pin tumbler lock of the present invention including a first service key for operating the lock.

FIG. 1 illustrates the improved changeable, axial pin tumbler lock in an exploded, perspective view including a first cylindrical service key 70 for operation of the lock. The lock includes a main housing or cylinder 20 which is generally cylindrical in shape and has a throughbore 22 for receipt of the various lock components. Positioned within the bore 22 is a stem or plug 24 which passes through an opening 25 and is keyed to an annular front barrel 26 so that plug 24 and front barrel 26 define a subassembly which is rotatable about a center line axis 28 of cylinder 20. Seven drive or key operated tumblers 30 are inserted in passages 32 defined in front barrel 26. Front barrel 26 also includes a shear face or shear surface 34 transverse to axis 28. In the following description, the positions of the tumbler passages 32 will be described in terms of the hour positions on a clock face. Passages 32 are provided at the 1, 2, 3, 5, 7, 9 and 11 o'clock positions when front barrel is maintained in the locked position of FIGS. 1–8.

Figure 2:
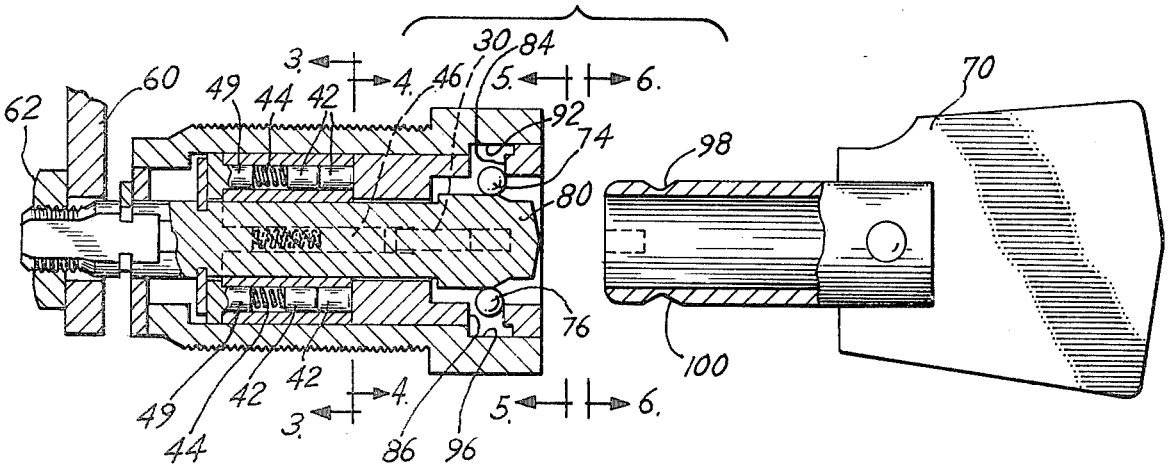
FIG. 2 is a side cross sectional view of an assembled lock of the type shown in FIG. 1 including the first service key taken along the line 2—2 in FIGS. 3 and 4.
Figure 4:
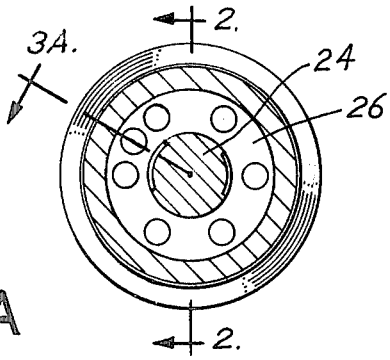
FIG. 4 is a transverse cross sectional view taken along the line 4—4 of FIG. 2.

A rear barrel 38 is keyed to the cylinder 20 or may be integrally fabricated as part of the cylinder 20. Rear barrel 38 includes a front shear surface 36 opposed to surface 34 and also has twelve (12) barrel passages 40 arranged at equal radial distances from the axis 28. Passages 40 are also equally spaced from each other and positioned at each hour position. Consequently, the rear barrel passages 40 at the 1, 2, 3, 5, 7, 9 and 11 o'clock positions are aligned with the seven front barrel passages 32 when the lock is in the locked or key receipt position as illustrated in FIGS. 1 and 2.

Two change tumblers 42 biased by springs 44 are provided for barrel passages 40 at the 4, 6, 8, 10 and 12 o'clock positions. The change tumblers 42 at the 4, 6, 8, 10 and 12 o'clock positions are biased by springs 44 against the surface 34.

Three change tumblers 42 are provided at the 2 o'clock position. The three change tumblers 42 provided at the 2 o'clock position project across the surface 34 into passage 32 in response to biasing by a spring 44.

The remaining rear barrel passages 40 at the 1, 3, 5, 7, 9, and 11 o'clock positions include locking pin tumblers 46 biased by springs 44 so as to project from the barrel passages 40 into corresponding, aligned front barrel passages 32 at the 1, 3, 5, 7, 9, and 11 o'clock positions. The locking pin tumblers 46 and tumblers 42 at the 2 o'clock position thus prevent rotation of the front barrel 26 with respect to the rear barrel 38 when the lock is in the position shown in FIG. 2.

The biasing springs 44 are retained in a compressed state within the assembly by means of a spring retainer plate 48 which includes biasing projections or studs 49 at all positions except the 2 o'clock position. Studs 49 extend into the barrel passages 40 to engage the springs 44 at all positions except the 2 o'clock position. The spring 44 at the 2 o'clock position is supported directly by the plate 48.

The plug 24, front barrel 26, rear barrel 38 and plate 48, as well as the described tumblers are retained in a locked or assembled condition by means of a first retainer ring 50 which cooperates with a slot 51 near the end of plug 24. The assembled plug 24, front barrel 26 and rear barrel 38 as well as the associated components described are inserted within the cylinder 20 and retained therein by a stop washer 64 held by a second retainer ring 54 which engages an end slot 56 of plug 24. The plug 24 and front barrel 26 are rotatable about the axis 28 whereas the rear barrel 38 is keyed to the cylinder 20 and is thus not rotatable about the axis 28.

A bolt 60 may be attached to the end of the stem or plug 24 by means of a bolt nut 62 so that upon rotation of the plug 24 and front barrel 26, the bolt 60 may be rotated from the locked position shown in FIG. 2 to an unlocked position. By appropriate choice of a stop washer 64 and bolt 60, both of which are keyed to the end of the stem 24, it is possible to limit or control clockwise or counterclockwise movement of the stem 24. That is, stops 66 and 68 on stop washer 64 cooperate with an associated lug 69 at the 12 o'clock position on the end of cylinder 20 to define the sense and rotation permitted by the plug 24 and attached rotatable parts.

A collar 41 fits over the housing 20 against flange 21. A nut 43 threads on the housing 20 to hold the lock in a door panel.

A first service key 70 includes a hollow cylindrical member 77 that is keyed to fit over the end 80 of the plug 24 and cooperatively engage the seven key or drive tumblers 30. With the present invention it is possible to use a first service or pass key 70 with the lock for effecting unlocking of the lock. Typically all service keys can be inserted or removed from the lock only when the lock is in the locked position. A first set key 71 having the same bitting or combination as the first service key 70 is also used to position the lock in the unlocked position. The first set key 71 unlike the service or pass key 70 is removable from the lock when in the unlocked position. Typically all set keys can be inserted or removed from the lock in both the locked and unlocked positions.

A second set key 73 may be inserted in the lock while it is still in the unlocked position for cooperation with the tumblers 30, 42, 46 and for setting a new lock combination. The second set key 73 is then rotated from the unlocked to the locked position and removed. A second service or pass key 75 having bittings or a combination identical to the second set key 73 is then used for unlocking the lock. In a similar fashion, the combination of the lock may be altered by an appropriate set key to receive a mating service key.

Detailed Tumbler Description

In the following description, a more detailed discussion of the tumbler configuration, the cooperative keys, the mechanism for retaining service keys, and the mechanism for permitting removal of set keys when the lock is in the unlocked position will be provided.

In the embodiment illustrated there are a total of twelve rear barrel passages 40. The barrel passages 40 are arranged at the hour positions of a clock face. When in the locked position, barrel passages 40 at the 1, 3, 5, 7, 9 and 11 o'clock positions include locking pins 46 extending across the shear interface defined by surfaces 34 and 36 to prevent rotation of front barrel 26 with respect to the rear barrel 38. The pins 46 are biased against the drive or key tumblers 30 and drive them toward the outer ends of the passages 32 in barrel 26.

Barrel 26 includes a counterbore 52 extending from the outside end thereof toward the surface 34. Counterbore 52 has a radius sufficient to partially cut away passages 32 and thereby expose active ends 31 of tumblers 30. The diameter of counterbore 52 is slightly greater than that of cylinder 77 associated with key 70. In this manner the active end of key 70 fits over plug 24 in counterbore 52 to engage the tumblers 30 and drive the tumblers 30 against the force of springs 44.

Tumblers 30 also include an inner head or flange 33 which is received in an associated counterbore 35 for each passage 32. The limit of forward travel of each tumbler 30 in each passage 32 is therefore controlled by one of two limiting surfaces:

1. The counterbore surface 37 of counterbore 35 which engages head 33, or
2. The end surface 39 of passage 32 which engages active end 31 of tumbler 30.

Since either limiting surface 37, 39 controls the biased position of tumblers 30, picking of the lock is made more difficult. Mere observation of tumbler position in the lock will not provide information with respect to travel required to unlock the lock. This feature is a significant anti-theft feature of the lock.

The tumbler heads 33 also hold the tumblers 30 in the front barrel 26 longer than the non-headed or straight pins of other locks. Some lock springs automatically "unload" the tumblers without heads when the lock cylinder is violated.

In review, the varied depths of counterbore 35 for each passage 37 as well as the varied depth of passages 32 make it difficult to "read" the lock combination by just looking or measuring the tumblers from the front of the lock. For further confusion of a lockpicker some of the tumblers may be held in place against passage end 39 in front barrel 26.

One remaining barrel passage 40 at the 2 o'clock position includes three change tumblers 42 which are biased by a spring 44 to project across surfaces 34, 36 to engage a key tumbler 30. The front plug barrel 26 thus has seven plug passages 32 corresponding to the 1, 2, 3, 5, 7, 9 and 11 o'clock positions with tumblers 46 or 42 extending across the interface and locking the barrels 26, 38.

The remaining rear barrel passages at the 4, 6, 8, 10 and 12 o'clock positions include springs 44 which bias against at least two change tumblers 42. The change tumblers 42 abut the shear surface 34. Consequently the change tumblers 42 are extra tumblers retained in storage barrel passages 40 at the 4, 6, 8, 10 and 12 o'clock positions available for altering the lock combination. Of course, some of the change tumblers 42 may already be incorporated in position to change the lock combination by transfer to the 1, 3, 5, 7, or 9 o'clock positions in the manner described below.

Figure 3:
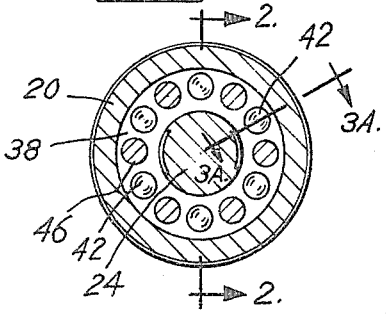
FIG. 3 is a transverse cross sectional view taken along the line 3—3 in FIG. 2.
Figure 3A:
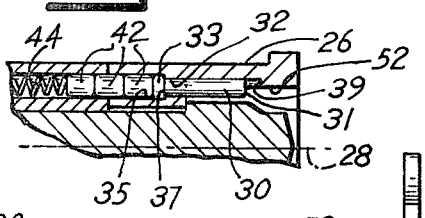
FIG. 3A is a partial side cross sectional view along the line 3A—3A in FIGS. 3 and 4.

Referring next to FIGS. 2–6, the lock of the present invention is illustrated in a locked position prior to insertion of first service key 70. FIG. 2 is a vertical section with tumblers shown at the 12 and 6 o'clock positions. The 3 o'clock tumbler position is also shown in phantom with the associated barrel passage 32. Tumblers at the 2 o'clock position are shown in FIG. 3A. FIGS. 3A, 8A, 9A, 12A and 13A will illustrate the tumbler configuration at the 12 o'clock position during various phases of lock operation.

Referring first to FIGS. 2, 3, 3A, and 4 and to the tumbler arrangement at the 12 o'clock position, note that barrel 38 has passage 40 with a stud 49 impinging against spring 44. Spring 44, in turn, biases two change tumblers 42 against surface 34. The tumbler arrangement at the 6 o'clock position is identical. At the 3 o'clock position, stud 49 engages spring 44 which engages locking pin 46 projecting across the shear surface and, in turn, impinging key tumbler 30. As shown in FIG. 3A, stud 49 is eliminated. Spring 44 is interposed between plate 48 and three change tumblers 42 in barrel 40 extending across surface 34 to engage a tumbler 30.

Key 70 is cooperative with the outer ends 31 of tumblers 30 by means of an array of seven bittings 78 arranged on the outside surface 79 of the active cylinder 77. Bittings 78 are defined by axial slots or grooves cut in the end of key 70. The bittings 78 are defined at the 1, 2, 3, 5, 7, 9, and 11 o'clock positions and cooperate with the key tumblers 30 at the 1, 2, 3, 5, 7, 9 and 11 o'clock positions upon insertion of key 70 in the annular opening defined by plug 24 and counterbore 52 in front barrel 26 as shown in FIG. 2.

Figure 5:
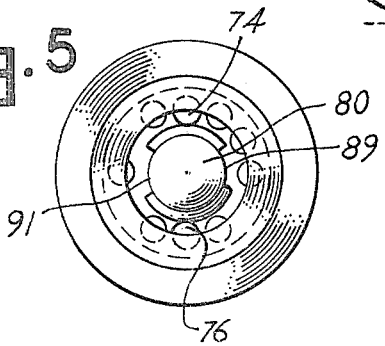
FIG. 5 is a transverse cross sectional view of the keyhole and of the lock of FIG. 2 taken substantially along the line 5—5.
Figure 6:
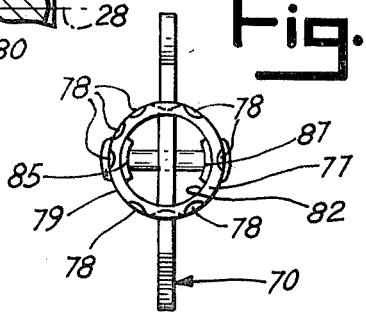
FIG. 6 is a transverse cross sectional view of the active end of the key as shown in FIG. 2 taken substantially along the line 6—6.

Inside surface 82 of the cylindrical section 77 of key 70 is keyed with the end 80 of plug 24. This is shown in FIG. 5 where internal lugs 85, 87 of key 70 are provided to engage detents 89, 91 respectively of plug 24 as shown in FIG. 6. All keys have similar internal lugs for keying and thus provide for simultaneous rotation of the key, plug 24 and front barrel 26.

Figure 9:
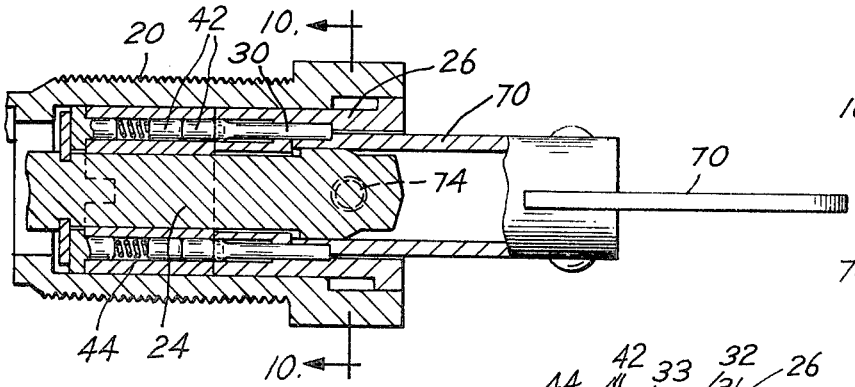
FIG. 9 is a side cross sectional view similar to FIG. 7 wherein the first service key of FIG. 7 has been rotated 90° in a clockwise direction to the unlocked position.
Figure 10:
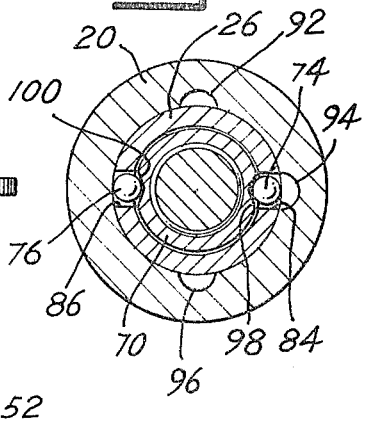
FIG. 10 is a transverse cross sectional view taken substantially along the line 10—10 in FIG. 9 illustrating the service key retention mechanism.
Figure 9A:
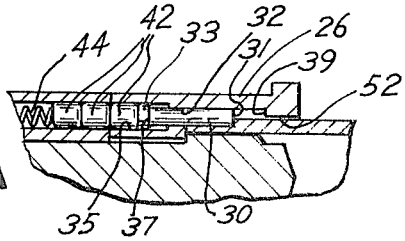
FIG. 9A is a partial side cross sectional view similar to FIG. 8A when the lock is in the position of FIG. 9.

The key 70 also cooperates with a key retention mechanism shown in FIGS. 9 and 10. Key retention mechanism is comprised of ball bearings 74, 76 that fit through circular openings 84, 86 in the 12 and 6 o'clock positions of the front barrel 26. Slots 92, 94, and 96 in housing 20 at the 12, 3 and 6 o'clock positions are provided for cooperation with the ball bearings 74 and 76. Rotation of the front barrel 26 with respect to the cylinder 20 causes the balls 74, 76 to ride out of slots 92, 96 respectively and move toward the center line axis 28. As the ball bearings 74, 76 are driven due to engagement with the inside surface of throughbore 72 toward axis 28, they protrude respectively through openings 84, 86 into detents 98, 100 respectively of key 70 to thereby grip and hold the key 70 tightly upon rotation from the locked position of FIG. 7.

Figure 7:
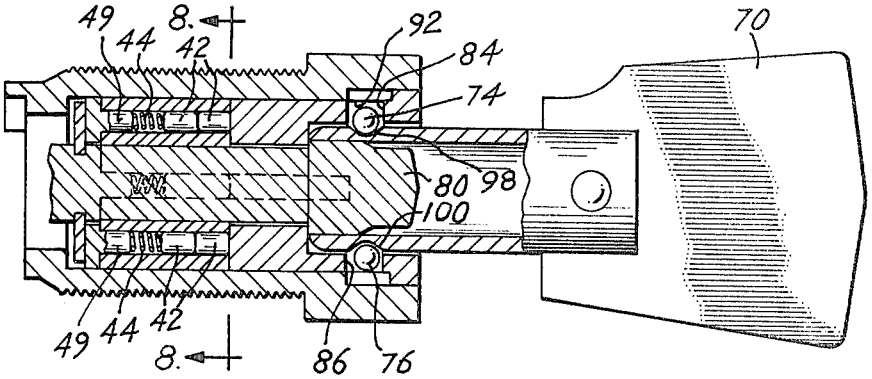
FIG. 7 is a side cross sectional view of the lock of FIG. 2 wherein the first service key has been inserted into the lock.
Figure 8:
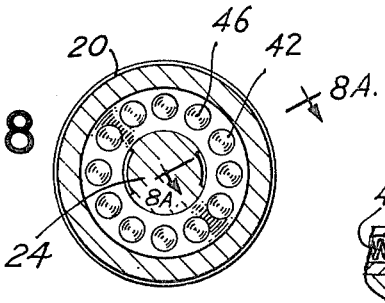
FIG. 8 is a cross sectional view taken substantially along the line 8—8 of FIG. 7.
Figure 8A:
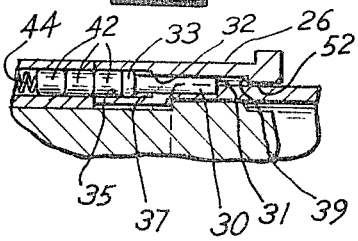
FIG. 8A is a cross sectional view along the line 8A—8A in FIG. 8.

Ball bearings 74, 76 prevent removal of the service key 70 from the lock except when the service key 70 is in the original or locked position as illustrated in FIGS. 2 and 7. FIG. 9 illustrates the position of the lock when the key 70 has been rotated to position the lock in the unlocked position. In FIG. 10 note that ball bearing 76 is retained against detent 100 of key 70 as a result of the absence of a cylinder slot, such as slot 94, at the 9 o'clock position. Thus key 70 is not removable from the lock. Ball bearing 74 falls into slot 94 and does not serve to retain key 70 and 90 deg. rotation to the unlocked position.

Figure 11:
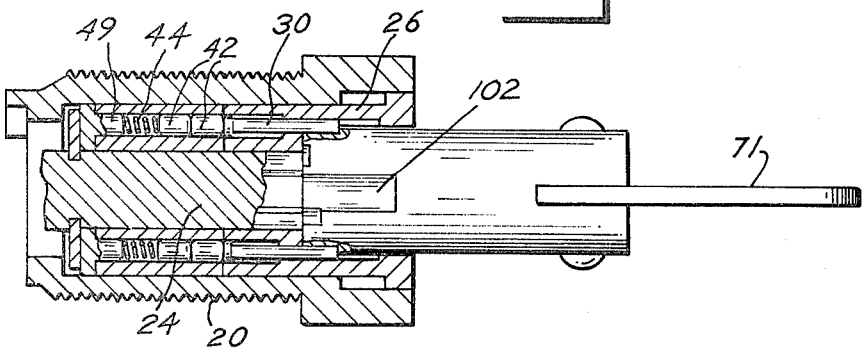
FIG. 11 is a side cross sectional view of the lock wherein a first set key has been positioned in the lock and rotated 90° clockwise.
Figure 12:
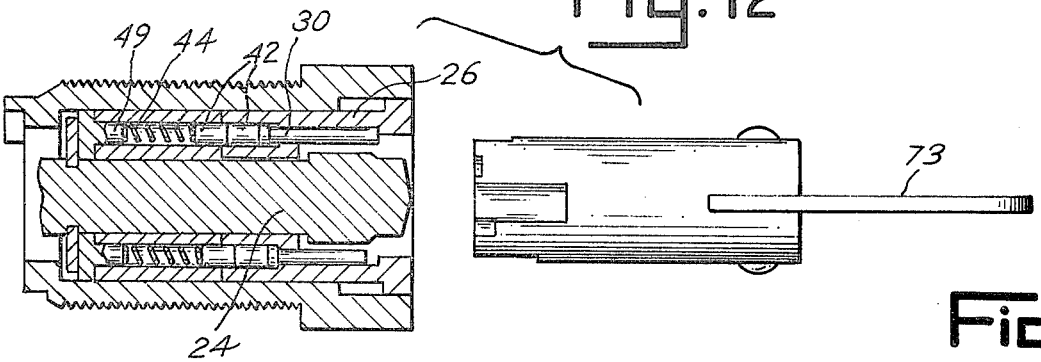
FIG. 12 is a side cross sectional view of the lock wherein the first set key has been removed from the lock and a second set key is placed in position for insertion into the lock so as to set a new combination of tumblers.
Figure 12A:
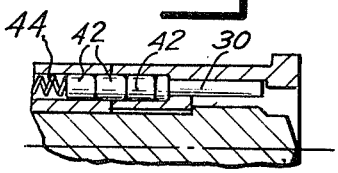
FIG. 12A is a partial side cross sectional view similar to FIG. 11A when the lock is in the position of FIG. 12.

In order to change the combination of the lock it is necessary to use the set key 71 which is bitted identically to the service key 70. Set key 71 also includes one extra groove 102 at the 6 o'clock position which eliminates detent 98 on the set key 71 only. The change is accomplished by inserting the set key 71 into the lock when the lock is in the locked position shown in FIG. 7. The set key 71 is then rotated 90 deg. clockwise to the unlocked position. The groove 102 permits removal of the set key 71 when the set key 71 is in the unlocked position as illustrated in FIG. 11. That is, since the set key 71 has a groove 102 rather than a detent 99, the ball bearing 76 does not engage and retain key 71 and it is possible to remove the set key 71 as shown in FIG. 12 and insert a substitute or second set key 73 having new or distinct bits for driving of the tumblers 30.

Figure 13:
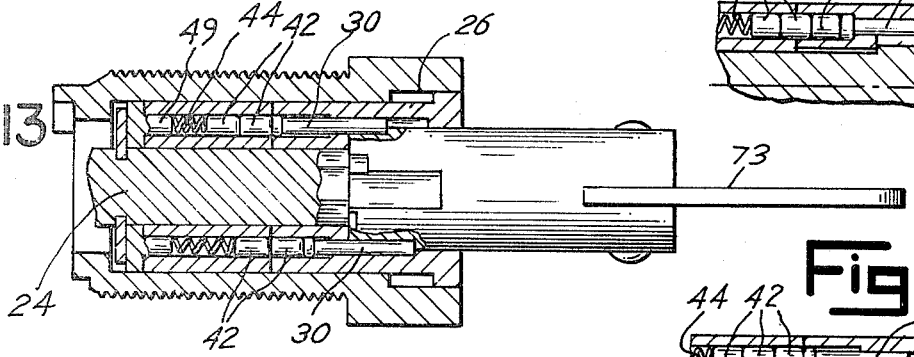
FIG. 13 is a side cross sectional view of the lock wherein the second set key has been inserted into the lock and the lock is ready for rotation of the second set key in the counter-clockwise direction in order to permit removal of the second set key and receipt of a second service key.
Figure 13A:
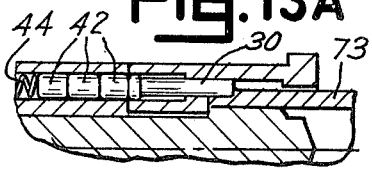
FIG. 13A is a partial side cross sectional view similar to FIG. 12A when the lock is in the position of FIG. 13.
Figure 14:
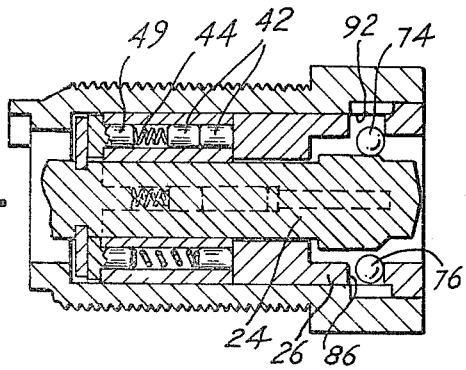
FIG. 14 is a side cross sectional view of the lock wherein the second set key has been rotated 90° counter-clockwise with respect to FIG. 13 and removed so that the lock is ready for operation by an appropriate second service key.
Figure 14:
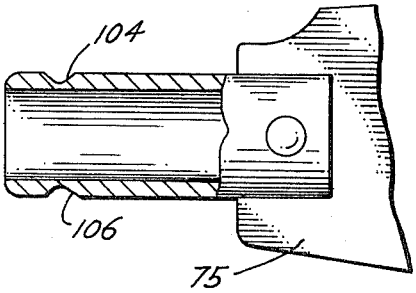

FIG. 13 illustrates a new set key 73. The new set key is inserted into the lock when the lock is in the position illustrated in FIG. 13 and is then turned to the position illustrated in FIG. 14. The new set key 73 may then be removed and put in a safe place until required for future changing of the combination. A new service key 75 (FIG. 14) may then be used to open and close the lock. The service key 75 has bittings identical to the new set key 73 and also includes detents 104, 106 equivalent to detents 98, 100 in key 70 to control removal of key 75.

Referring again to the figures, following is an explanation of the operation of the tumblers 30, 42, 46 in the various passages 32, 40 whereby a change in the combination for the lock may be effected. Referring first to FIGS. 2–6 it will be noted that the tumblers 42 positioned in barrel passages 40 at the 4, 6, 8, 10 and 12 o'clock positions abutt the shear surface 34 and do not provide any locking action in the locked position. By contrast, locking pins or tumblers 46 associated with drive tumblers 30 at the 1, 3, 5, 7, 9 and 11 o'clock positions extend across the shear interface defined by surfaces 34 and 36. This provides a locking action for the lock. Additionally, a drive tumbler 30 and three change tumblers 42 are positioned within the passages 40 and 32 at the 2 o'clock position and extend across the interface defined by shear surfaces 34 and 36 to provide additional locking action for the lock.

Insertion of the key 70 drives the tumblers 30 to the position illustrated in FIG. 7 such that all of the tumblers 30, 42, 46, have their ends coincident with the shear interface defined by surfaces 34 and 36. This permits rotation of the plug member 26 with respect to the barrel 38 to the position illustrated in FIG. 9, i.e. the barrel 26 is rotated 90° clockwise to align the 12 o'clock passage 32 with the 3 o'clock passage 40 and so on for the other passages 32, 40. Since the service key 70 illustrated in FIG. 9 is not removable, the lock as shown in FIGS. 7 and 9 is merely operable by operation of the service key 70.

As previously described, a set key 71 of identical bitting to the service key 70 may be inserted into the lock in the locked position in order to permit 90° rotation to the unlocked position shown in FIG. 11. The set key 71 as shown in FIG. 11 may then be removed. The amount of rotation of the plug member 26 with respect to the barrel in the embodiment disclosed in 90° although the lock may be designed for any rotation provided the combination is effected by placing the front barrel passages 32 over those rear barrel passages 40 which serve as storage passages.

Removal of the set key 71 then permits changed tumblers 42 at the 2, 4, 6, 8, 10 and 12 o'clock positions to move with respect to the shear surfaces 34 and 36. Then a new set key 73 having a new bitting will re-arrange the tumblers 42 on one side or the other of the shear surfaces 34 and 36. This new arrangement of tumblers 30, 42 may then be rotated counterclockwise to the key locked position by operation of the new set key 73; whereupon, the key 73 is removed and a new service key 75 having bitting identical to the second set key 73 may be used to operate the lock. In the FIGURES a tumbler 42 is transferred from storage barrel 40 at the 6 o'clock position in FIG. 13 to the 3 o'clock position in FIG. 14. This change is effected by the change in bitting 78 which permits the tumbler 42 to be carried in barrel 26 as shown in FIG. 13 as compared to FIG. 11 where both tumblers 42 were retained in storage barrel 40 by first set and first service keys 71, 70. Tumblers 42 are changed at the 2, 4, 8, 10 and 12 o'clock positions in a similar manner by changing the bittings 78.

It is possible to vary the number of passages 40 in the barrel 38. Generally the number of passages in the barrel 38 is two times the number of passages 32 in the plug member 26. Additionally, all of the passages 32, 40 have a common cross sectional size and shape. Also, all of the passages 32, 40 are at substantially the same radial distance from the axis 28 and are preferably spaced an equi-angular amount. Of course, a great number of set keys may be used to change combinations for the lock depending upon the travel and length of tumblers 42 and tumblers 30.

Other variations from the particular structure described are possible while still retaining the scope and intent of the invention. For example the number and length of change tumblers 42 may be varied. The number of rear barrel passages 40 and front barrel passages may be varied. The amount or rotation of the front barrel may be controlled by means of the ball bearing key retention mechanism. The number of ball bearings and cooperative slots associated with the key retention mechanism may be varied since the ball bearing retention mechanism acts as a radial tumbler system. The invention, therefore, is to be limited only by the following claims and their equivalents.

What is claimed is:

1. An improved changeable, axial pin tumbler lock cooperative with a service key for normal lock operation and cooperative with set keys for changing the lock tumbler combination for subsequent cooperation with a different service key, said lock comprising, in combination:

a fixed barrel having a center line axis, a shear surface transverse to the axis, and a plurality of (n) tumbler passages generally parallel to the axis and to each other, said passages arranged at equal radial distances from the axis;

a rotatable barrel rotatable about the axis and having a shear surface in opposed relation to the fixed barrel shear surface to define a single line of cleavage between the barrels, said rotatable barrel also including a front surface and less than (n) parallel, front tumbler passages, said front tumbler passages being arranged parallel to the axis and in alignment with selected fixed barrel passages when said lock is in the locked position, all of said rotatable barrel passages being at the same radial distance from the axis and also having the same cross sectional shape as the fixed barrel passages, those fixed barrel passages which are not selected for alignment defining storage passages;

bolt means attached to the rotatable barrel and operated in response to rotation of said rotatable barrel;

a plurality of changeable pin tumblers in the fixed barrel storage passages;

locking pin tumblers extending from the fixed barrel passages into the aligned rotatable barrel passages when in the locked position;

biasing means in the fixed barrel continuously biasing tumblers in the fixed barrel passages toward the rotatable barrel shear surface;

drive tumblers having inner tumbler ends in the rotatable barrel passages for engagement by the locking pin tumblers when the lock is in locked position and having opposite ends projecting toward the rotatable barrel front surface for cooperation with a key; and means for retaining the drive tumblers in said rotatable barrel, said drive tumblers being arranged for engagement by a first service key or an identically bitted first change key for axial translation to position the inner tumbler ends at the single line of cleavage whereby the rotatable barrel may be rotated between a locked and unlocked position, at least one of said rotatable barrel passages being aligned with a fixed barrel storage passage when the lock is rotated to a combination change position, said first change key being removable at both the locked and combination change positions whereby at the combination change position a second change key with a distinct bitting may be inserted in the lock to transfer tumblers to or from the storage passage and thereby alter the lock combination.

2. The improved lock of claim 1 including means for retaining a service key engaged with said lock when said service key is rotated from an initial engagement position with the lock whereby said service key engages and drives said tumblers in a direction along the axis and away from the front surface to thereby define a free shear surface between the barrel and plug uninterrupted by any tumbler, and whereby a set key matching the service key is removable from said lock upon engagement with the lock and upon subsequent rotation of the front barrel to the combination change position.

3. The improved lock of claim 1 including twelve (12) fixed barrel passages at the hour positions of a clock face in transverse section, and at least six (6) rotatable barrel passages at alternate hour positions of a clock face in transverse section.

4. The improved lock of claim 1 wherein said barrel passages are equally spaced from each other.

5. The improved lock of claim 2 wherein said means for retaining the service keys comprise a radially movable bearing member in the rotatable barrel engageable with a key, and means for driving the bearing member into locking engagement with the key at selected key orientations.

6. The improved lock of claim 1 including means on said rotatable barrel for indexing a key with respect thereto.

7. The improved lock of claim 6 wherein said means for indexing comprise a plug projection from the front surface for engaging a key, said projection including an indexing groove cooperative with an indexing projection of the key.

8. The improved lock of claim 1 wherein said fixed barrel includes an axial opening and said rotatable barrel includes a stem extension having an inner end extending through the axial opening, said bolt means being attached to the end of the stem extension and responsive to rotation of the stem and rotatable barrel.

9. The improved lock of claim 1 including at least two (2) change tumblers in each storage barrel passage.

10. The improved lock of claim 1 wherein the drive tumblers included a head at the inside end and said front barrel includes a counterbore at the inside end to receive the drive tumbler head.

11. The improved lock of claim 10 wherein at least one counterbore of a front barrel passage is adapted to limit travel of a drive tumbler toward the front end of the lock.

12. The improved lock of claim 1 wherein the front barrel includes a counterbore from the front end, said counterbore having a radius measured from the axis which provides for intersection of the counterbore with each passage whereby a key inserted into the counterbore engages and drives the drive tumblers.

* * * * *